United States Patent [19]

Fitch

[11] Patent Number: 4,726,587

[45] Date of Patent: Feb. 23, 1988

[54] OPTICAL BOWLING PIN SENSOR

[76] Inventor: Robert C. Fitch, 25 E. Wayne Avenue, Apt. 213, Silver Spring, Md. 20901

[21] Appl. No.: 884,771

[22] Filed: Jul. 11, 1986

[51] Int. Cl.[4] ..... A63D 5/04

[52] U.S. Cl. ..... 273/54 E; 273/54 C; 250/222.1

[58] Field of Search ..... 273/54 C, 54 E; 250/222.1

[56] References Cited

U.S. PATENT DOCUMENTS

| | | | |
|---|---|---|---|
| 3,501,644 | 3/1970 | Berler | 273/54 E |
| 3,804,408 | 4/1974 | Saito et al. | 273/54 E |
| 3,825,749 | 7/1974 | Gautraud et al. | 273/54 E |

*Primary Examiner*—Leo P. Picard

*Attorney, Agent, or Firm*—William Brinks Olds Hofer Gilson & Lione

[57] ABSTRACT

An optical bowling pin detector wherein light reflecting from the top five inches of each pin is directed to a linear array of photosensitive devices by an anamorphic lens. The detector is positioned so it can view all the bowling pins without moving.

11 Claims, 10 Drawing Figures

FIG 6A
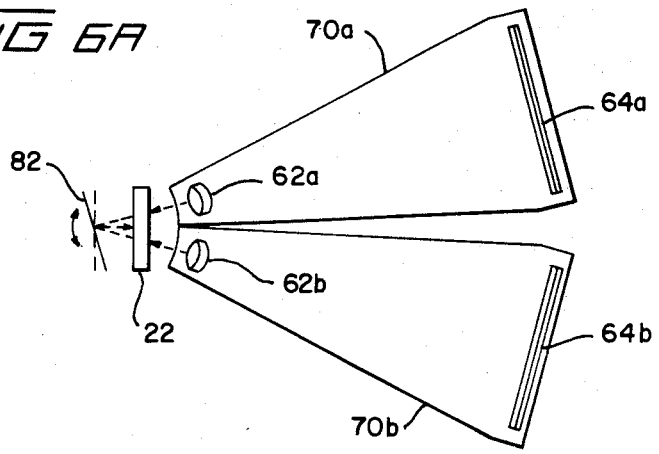
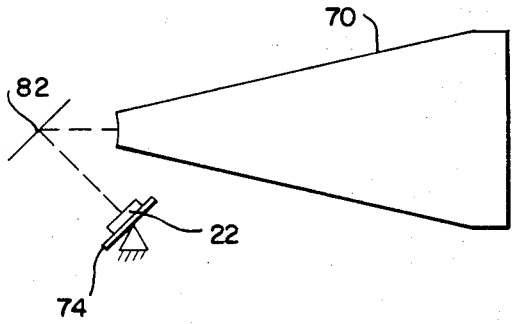
FIG 6B
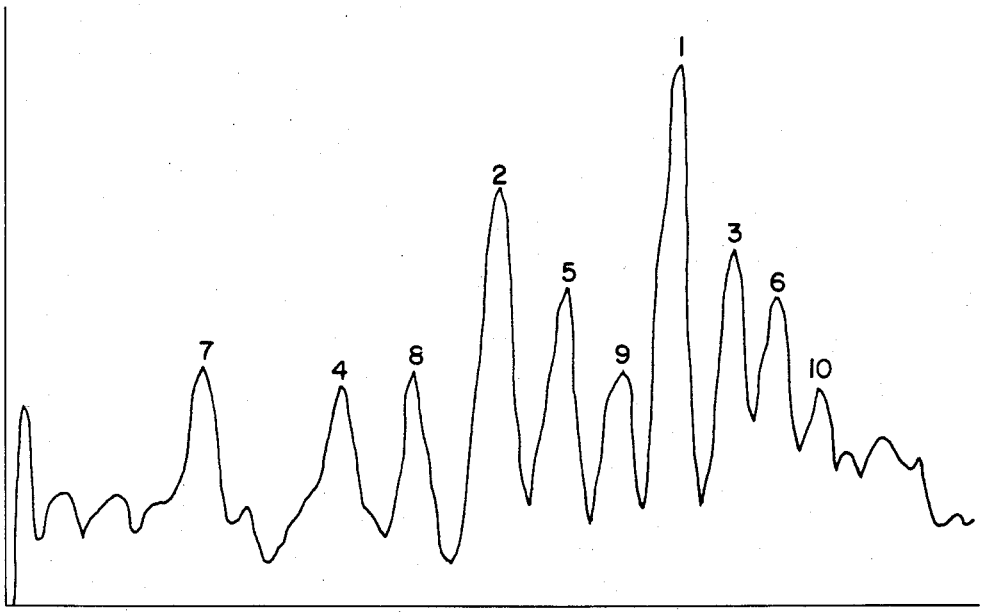
FIG 8

OPTICAL BOWLING PIN SENSOR

A number of different types of systems are known for detecting bowling pins standing on the pin deck of a bowling lane. The count of standing pins is used to activate respective lights in a "Pindicator" display device that is above the lane and displays to the bowlers which pins are standing. Also, standing pin signals are used in automatic bowling scorers as the input signals that are used for automatically computing and displaying the players' running scores of a game. Early efforts in bowling pin detection involved the use of electrical switches that were placed in or under the pin spots on the pin deck, or on the pin setter mechanism that picks up standing pins. More recently, optical and acoustic pin sensing systems have been in commercial use. Examples of such systems are contained in U.S. Pat. Nos. 3,825,749; 3,847,394; 4,140,314; 4,148,480; and 4,148,181.

Bowling establishment proprieters keenly compete with other recreational activities for customers and must maintain their operations as efficient and cost effective as possible. This requires that their initial investments in equipment, such as bowling pin detecting and automatic scorers, be kept to a minimum. Further, the equipment must be easy to install and to repair, and must be as trouble free in its operation as possible.

The acoustic systems of the above mentioned patents, and other known acoustic systems, operate successfully, but the initial costs and the installation expenses were more than desired. Further, the acoustic systems require long, multiple pulses of acoustic energy to accurately detect the pins. These relatively long pin sensing periods have required that delays be introduced into the operation of the pin setting operation. This slows down the play and is undesirable.

The optical pin sensing apparatus of this invention is a relatively inexpensive system that has simple component parts that are easy to install and maintain. A further advantage is that no additional light source is necessary because the light already provided in the pin deck area of the bowling lane is adequate for reliable sensing of the standing pins.

A further advantage of the present invention is that the optical system compresses the vertical image of the top portion of the standing pins on the pin deck into a very much smaller dimension and thus, in effect, integrates out the small flaws, imperfections, and scuff marks on the surfaces of the pins that otherwise might affect the reflectivity of the pins and the ability of the photo detector to see the pin heads.

The invention will be described by referring to the accompanying drawings wherein.

Figure 4A:
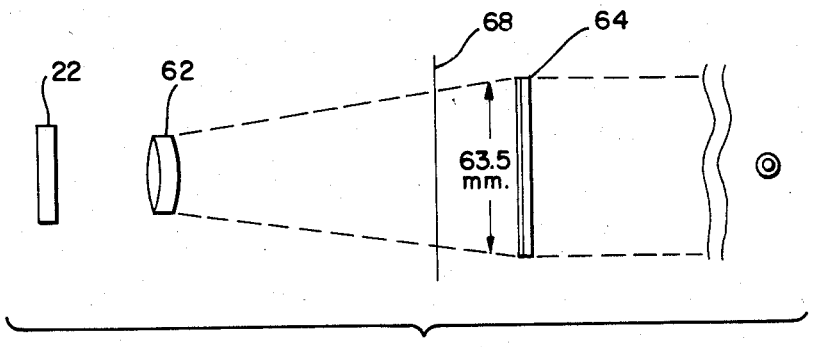
Figure 4B:
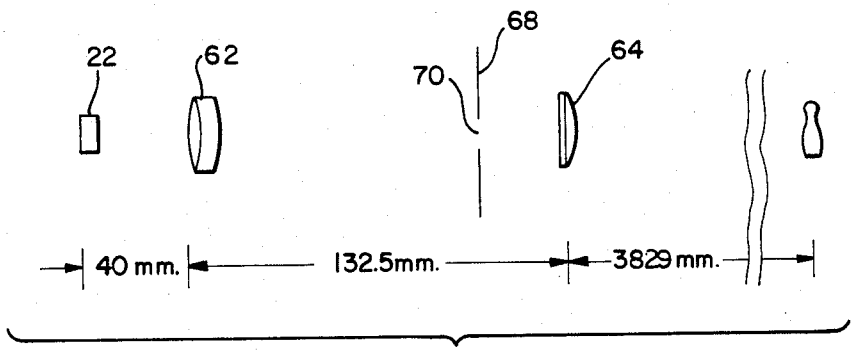
Figure 5:
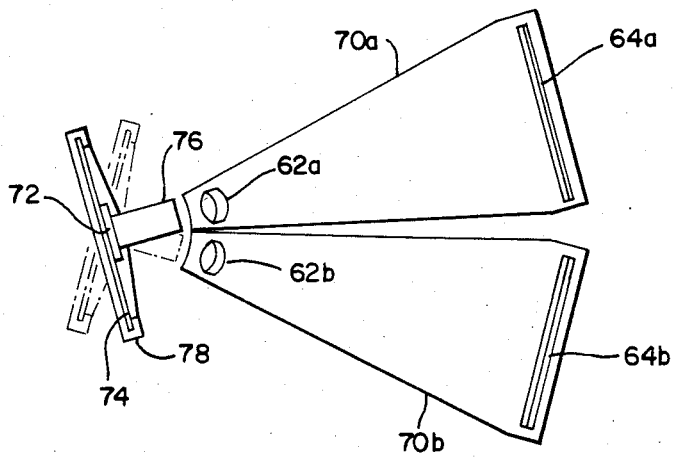

FIGS. 4*a* and 4*b* are simplified top and side illustrations of the optical system that is employed in this invention;

FIGS. 5, 6*a* and 6*b* are simplified illustrations of alternative embodiments of optical systems constructed in accordance with this invention.

Figure 7:
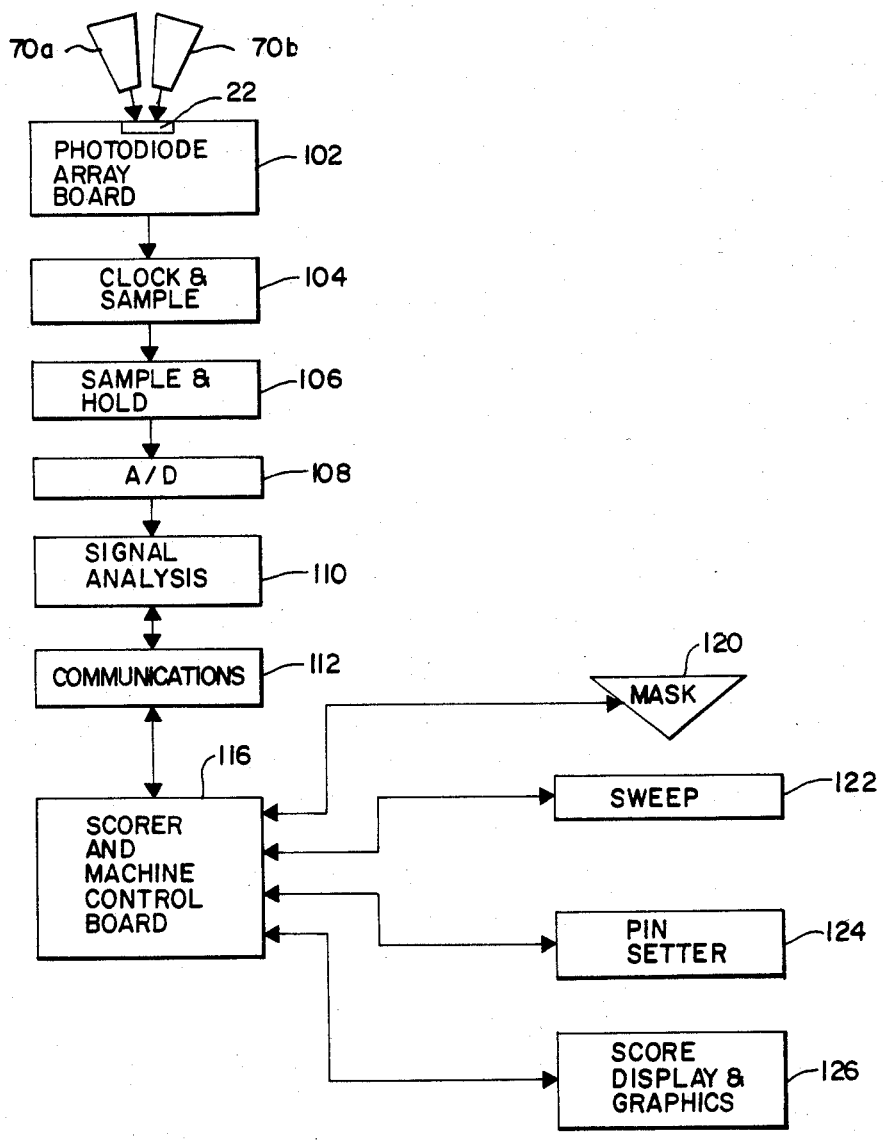

FIG. 7 is a simplified block diagram of a bowling scoring system in which this invention may be used; and FIG. 8 is a waveform diagram of analog signals resulting from the pin sensor of this invention.

Figure 1:
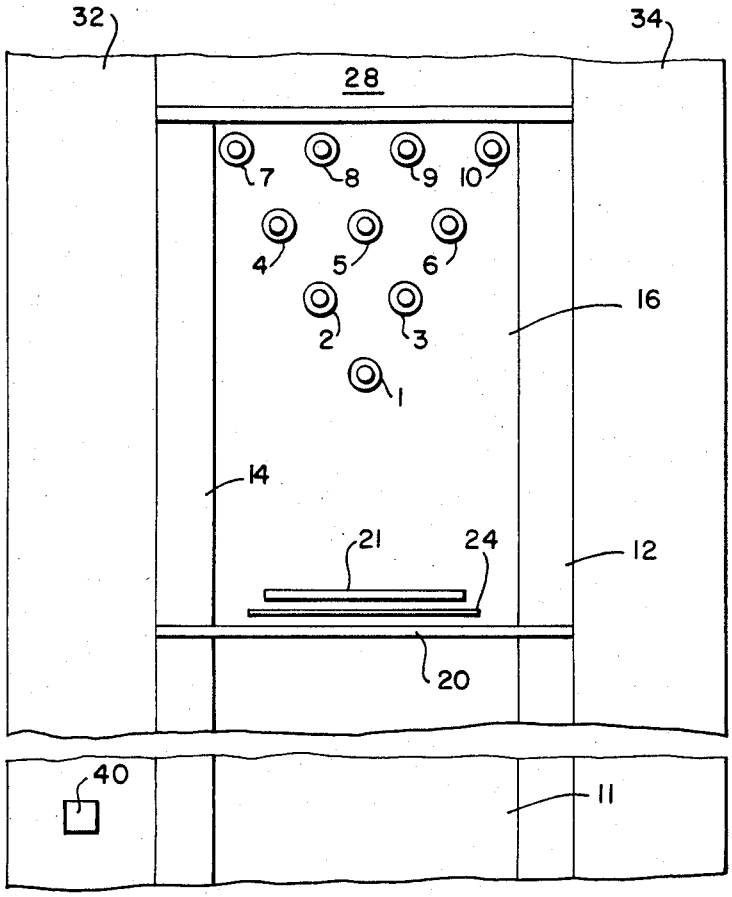
FIG. 1 is a simplified illustration of the pin deck area of a bowling lane and shows the general features of the pin sensing system of this invention.

Referring now in detail to FIG. 1, there is shown in simplified form the pin deck region of a typical bowling lane on which a ten pin game of bowling is played. Bowling balls are rolled on the lane 11 which has gutters 12 and 14 running along each side. The ten bowling pins 1–10 are spotted in their usual triangular pattern at the back end of the pin deck area 16. As is customary in bowling establishments, a mask 20 extends from the ceiling down over the pin deck area so that substantially only the pins are visible from the bowler's end of the lane. As is conventional, a commercially available, commonly used, elongated flourescent lighting tube 21 is suspended behind mask 20 to illuminate the pins on pin deck 16. A light reflector 24 is positioned in front of flourescent tube 21 to help direct light onto the pins on pin deck 16. Pit area 28 is immediately behind pin deck 16 and the pin setting apparatus (not illustrated) is positioned in its usual place above and behind the pin deck area. The regions 32 and 34 on each side of lane 11 include the cowlings that cover the ball return tracks that extend from the pit area 28 to the bowlers end of lane 11. To each side of ball return cowlings 32 and 34 are adjacent lanes. The optical pin sensing apparatus of this invention is positioned in front of pin deck area 16 at a location 40 on the cowling of the ball return track.

Figure 2:
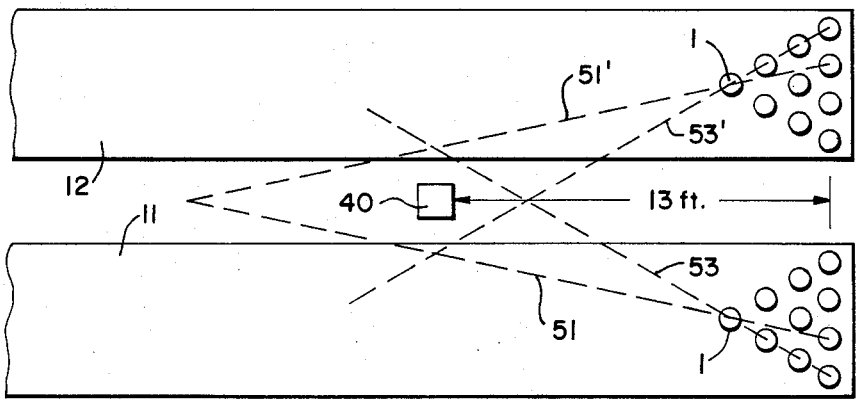
FIG. 2 is a simplified illustration showing how the location for the pin sensor is selected.

Location 40 is selected so that an optical sensor device located there will have an optimum, unobstructed view of all pins on a pair of adjacent lanes. FIG. 2 illustrates the manner of selecting the sensing location 40. Looking at lane 11, the viewing paths 51 and 53 are unacceptable choices for viewing the pins because head pin number 1 blocks the view of the pins behind it. Looking at lane 12, the viewing paths 51' and 53' also are poor choices for the same reason. By continuing the viewing paths 51,53 and 51', 53' to the left where the respective similarly numbered pairs intersect, it will be seen that there is a region between the intersection of those pairs where the viewing of the pins on the adjacent lanes is optimum since the head pin does not obstruct to any substantial degree the view of the pins behind it. In practice, location 40 is approximately 13 feet from the back row of pins on the lanes.

As viewed from location 40, the horizontal field of view of a full set of pins on a pin deck will cover approximately 50 inches, including several inches on each side of the set of pins to account for pins being knocked off their spots by a ball and/or pin action.

In accordance with this invention, the standing pins on the pin deck are viewed by means of an anamorphic lens system which produces a greater reduction of the image of the set of standing pins in the vertical direction than it does in the horizontal direction. The reason for this, and the explanation as to how this is accomplished, will be referred to in connection with FIGS. 4–6.

Figure 3:
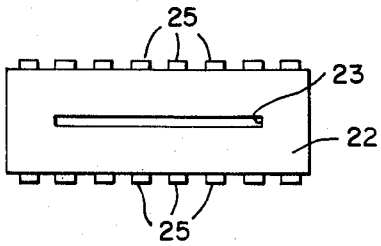
FIG. 3 is a simplified illustration of DIP package housing of a photodiode array that is suitable for use in this invention.

The photoelectric transducer that I have employed with success in my invention is a linear array of monolithic semiconductor diodes that is housed in a thin rectangularly shaped DIP package 22, FIG. 3, that has a viewing aperature 23 in one face of the package. One type of such device that I have successfully used is a RL-512G Solid State Line Scanner marketed by Reticon Corporation, a subsidiary of EG & G, Inc., Wellesley, Mass. This device is a monolithic self scanning device comprising a row of adjacent silicon photodiodes, each with a respective storage capacitor which integrates the photocurrent, and a multiplexer switch for periodically reading out the charge on the capacitor by way of an integrated shift register scanning circuit. The sensing area is a long narrow rectangular region defined by aperture 23 in an opaque mask. A glass or quartz window covers aperture 23. The entire area of monolithic material is photosensitive. Photocurrent generated by light incident between the photodiodes will be collected by the nearest diode. The charge output of each diode, below saturation, is proportional to exposure, i.e., the light intensity multiplied by integration time. The device is packaged in a typical DIP electronic package that has the integral leads 25 extending outwardly and downwardly from the package. Packages with various different numbers of photodiodes are available. For example, the number of photodiodes in an array may vary from 128 to 1024. It should be understood that other arrays of photosensitive devices, such as phototransistors and other semiconductor and/or crystalline devices may be used in place of the photodiodes so long as discrete regions of the device may be individually sampled. In keeping with the preferred embodiment of this invention, the photosensitive devices should be in a single linear array of side-by-side devices.

In the 512 diode array, i.e., R.L. - 512G, the aperture 23 is approximately 0.5 inch long and 0.001 inch high. From the viewing location 40, FIGS. 1 and 2, the horizontal field of view of the entire set of standing pins, plus several inches on each side, is approximately 50 inches. To focus this horizontal field of view onto the 0.5 inch linear array of diodes requires an optical system having a horizontal reduction factor R of 100. With the distance U from the back row of pins (object) to the achromatic lens of the object system i.e., location 40, being 13 feet, or 156 inches, the focal length F of a lens that will provide the reduction R equal to 100 is provided by the formula $$F = \frac{U \times 1/R}{1/R + 1} = \frac{156'' \times 1/100}{1/100 + 1} = 1.544 \text{ inches, or } 39.23 \text{ mm.}$$

Therefore, a 40 mm focal length lens will focus the horizontal field of view onto the 0.5 inch photodiode array.

The vertical dimension of the viewing aperture 23 of the photodiode array is only 0.001 inch. Using the 40 mm lense, the portion of a standing bowling pin that would be viewed by the array would be $0.001 \times 100$, or 0.1 inch. Viewing such a narrow region on a bowling pin would be impractical because a dent, scuff mark, or color blemish on the very narrow area of the pin head being viewed might cause the light to be reflected or absorbed in such a manner that the photodiode array would not "see" the standing pin. This situation is unacceptable for a commercial bowling pin sensor.

For optimum view and discrimination between adjacent pins, it is desirable that only about the top five inches of the pins, i.e., the top third of the pins, be viewed by the optical system. Accordingly, the optical system of this invention is aligned to "see" approximately only the top five inches of the pins. To reduce a five inch object to an image that fits into the 0.001 inch vertical dimension of the photodiode array requires a reduction factor R equal to 5/0.001 or 5,000. The 40 mm lens discussed above provides a reduction factor of 100 so that an additional reduction factor of 50 is required to focus the desired vertical field of view onto the 0.001 high aperture. Because the horizontal field of view already is satisfactorily taken care of by the 40 mm lens, the focusing of this field of view should not be altered.

I accomplish the desired reduction in the vertical field of view by the additional factor of 50 without further affecting the horizontal field of view by employing an anamorphic or cylindrical lens in combination with the 40 mm lens. (The cylindrical lens has substantially no effect on the horizontal field of view).

The focal length of the cylindrical lens is computed as follows.

$$F = \frac{U \times 1/R}{1/R + 1} = \frac{156'' \times 1/50}{1/50 + 1} = 3.05 \text{ inch, or } 77.47 \text{ mm.}$$

It also is possible to use a shorter focal length anamorphic or cylindrical lens and a mask that will block out a portion of the vertical dimension of the larger image produced by that lens.

FIGS. 4*a* and 4*b* are simplified top and side views, respectively, of the lens system of this invention. The photodiode array 22 is illustrated on the far left. Lens 62 is the 40 mm lens discussed above and may be an achromatic, cemented, double convex lens having an 18 mm diameter. Lens 64 is the anamorphic or cylindrical lens discussed immediately above and may be a plano-convex, cylindrical lens that is 63.5 mm long, and 16 mm high. Approximate dimensions and distances of one successfully operating bowling pin sensor are given in FIG. 4*b*.

A mask 68 having a slit 70 therein may be positioned between lenses 62 and 64 to reduce the stray light incident on photodiode array 22. Of course, a suitable lens housing will be provided for the arrangement of FIG. 4. It will be understood that the lens selection and arrangement described in connection with FIG. 4 is an example only, and other lenses and dimensions, and different numbers of lenses, may be selected. In keeping with this invention, the lens system must be anamorphic in order to present an image of the standing pins at the aperture of the linear photodiode array 22 that has a reduction ratio of approximately 100 in the horizontal direction and a reduction ratio of approximately 5000 in the vertical direction.

FIG. 5 is a simplified illustration of a bowling pin sensor adapted to be mounted at a location 40, FIG. 1, on the cowling of a ball return track between a pair of adjacent lanes. There are two identical sets of lenses 62,64 and 62*b*, 64*b*, each arranged as described in connection with FIG. 4. Each set is supported within a respective opaque lens housing 70*a*, 70*b* that may include the mask 68 of FIG. 4. Linear photodiode array 22 and its associated electronic circuit board 74 are fixedly mounted on a housing 78 that is pivotable, by means not illustrated, to selectively be in alignment with lenses 62*a*, 64*a* or 62*b*, 64*b*. An opaque light tube 76 extends from the aperture of photodiode array 22 to proximate the ends of the respective housings 70*a*, 70*b*. Each of the lens systems 62*a*, 64*a* and 62*b*, 64*b* has its optic axis aligned to direct an image of its respective set of standing pins onto the aperture of photodiode array 22 when the light tube 76 is aligned with the respective lens system. Thus, one optical sensor assembly as illustrated in FIG. 5 services two adjacent lanes.

Instead of pivoting the photodiode array between two fixed positions as illustrated in FIG. 5, the arrangement illustrated in FIGS. 6a and 6b may be employed wherein photodiode array 22 is fixed in position below the axes of optical systems 62a, 64a and 62b, 64b and a pivoting mirror 82 moves between two positions at which it reflects the images from the respective optical systems onto the aperture of photodiode array 22.

Other embodiments of this invention are possible. For example, a double prism system may be employed in place of cylindrical lens 64. Further, a pivoting prism may be used in place of the pivoting mirror 82 in FIGS. 6a and 6b.

An attractive feature of this invention is that an additional light source is not required to illuminate the pin heads in the pin deck region of the lane. The commercially available photodiode array is sufficiently sensitive to provide reliable pin sensing with the light that is ordinarily provided in a bowling establishment. This eliminates a substantial initial cost and installation expense for the bowling proprieter. Further, as previously mentioned, the integrating effect of reducing the vertical image of the pins onto the very small aperture of the photodiode array substantially eliminate the adverse effect that dents, blemishes, and scuff marks on the pins might have on the reflectivity of a specific portion of the pins.

The optical pin sensor of this invention is part of a bowling scoring and pin setting machine control system of the general type that is known for automatically controlling the bowling game. Although the remainder of such an automatic system is not the subject of this invention, the relationship is illustrated in the simplified block diagram of FIG. 7. The lens assembles 70a and 70b function to provide the standing pin optical images to photodiode array 22 whose operation is controlled by electronics on its board 102. The analog electric signals from photodiode array board 102 are coupled through a clock and sample board 104 to sample and hold circuit 106. FIG. 8 is an illustration of the analog signals corresponding to ten detected standing pins as those signal would appear at the output of clock and sample board 104.

The signal then are converted to digital form in analog to digital converter 108. The digital signals are analyzed and processed by suitable signal processing algorithms in a signal analysis board 110 to provide respective digital signals corresponding to detected standing pins. A programmed Texas Instruments TMS 32010 Finite Impulse Response integrated circuit device may be used for signal analysis board 110.

Pin fall signals then are routed by communications board 112 to bowling scorer and machine control board 116. Board 116 provides the appropriate signals to "Pindicator" mask 120 to light lamps corresponding to standing pins, and provides score and graphics data and control signals to score display and graphics means 126 to prove a CRT display of the teams' bowling scores. A bowling scoring display system is described in U.S. patent application Ser. No. 678,304. The pin sweep mechanism 122 and pin setter mechanism 124 also are controlled by machine control board 116 and in turn provide signals to board 116 indicating their positions and states of operation.

In its broader aspects, this invention is not limited to the specific embodiment illustrated and described. Various changes and modifications may be made without departing from the inventive principles herein disclosed.

I claim:

1. A bowling sensor for sensing bowling pins standing on the pin deck of a bowling lane, comprising the combination a linear array of photosensitive devices that are responsive to light incident thereon, the length of said array being many times greater than the height of the photosensitive portion of a device in the array, an anamorphic optical system disposed in front of said array for directing an image of a full set of pins on the pin deck onto said linear array of photosensitive devices, said linear array of photosensitive devices and said optical system being adapted to be mounted adjacent each other in front of said pin deck, said optical system being constructed and arranged to project substantially onto the photosensitive portion of said linear array an image of said standing pins that includes only about the top five inches of a full set of pins standing on their respective spots on the pin deck and only approximately the full width of said full set of pins standing on their respective spots on the pin deck.

2. The bowling pin sensor claimed in claim 1 wherein said array is a single array of individual photosensitive devices aligned along on axis.

3. The bowling pin sensor claimed in claim 2 wherein said optical system is fixed in position relative to said pin deck, and wherein said array of photosensitive devices is fixed in position relative to the optical system when the array is operative to receive an image from the optical system.

4. The bolwing pin sensor claimed in claim 3 wherein said optical system includes a cylindrical or anamorphic lens whose major axis is parallel to the horizontal field of view of the standing pins and parallel to said array of photosensitive devices.

5. The bowling pin sensor system claimed in claim 4 wherein the optical system includes achromatic lens means positioned to receive the image of said portion of the pins from the cylindrical lens and to project that image onto substantially only the single array of photosensitive devices.

6. A bowling sensor for sensing bowling pins standing on the pin deck of a bowling lane, comprising the combination, a linear array of photosensitive devices that are responsive to light incident on the array, the array of devices being many times longer than its height, an anamorphic optical system disposed in front of said linear array, means for mounting said linear array and said optical system on the side of said bowling lane in front of the pin deck with the optical system being fixedly directed at pins standing on the pin deck, said optical system being constructed and arranged to project substantially only onto the photosensitive portion of said linear array an image of said standing pins that includes only about the top one third of each pin of a full set of pins standing on their respective spots on the pin deck and only approximately the full width of said full set of pins standing on their respective spots on the pin deck.

7. The bowling sensor claimed in claim 6 and further including a second optical system substantially identical to the first-named optical system and located at said means for mounting the array and the first optical system, said first optical system being fixedly positioned to provide an image of said part of the bowling pinst that are spotted on a first lane on one side of the mounting means and said second optical system being fixedly positioned to provide an image of said part of the bowling pins that are spotted on a second lane on the other side of the mounting means, and means for selectively directing the image from one of said optical systems onto said linear array.

8. The bowling pin sensor claimed in claim 7 wherein said array is a single array of individual photosensitive devices aligned along an axis.

9. The bowling pin sensor claimed in claim 8 wherein each of said optical systems includes a cylindrical lens whose major axis is parallel to the horizontal field of view of the standing pins and parallel to said array of photosensitive devices.

10. The bowling pin sensor system claimed in claim 9 wherein each optical system includes achromatic lens means positioned to receive the image of said portion of the pins from the cylindrical lens and to project that image onto substantially only the single array of photosensitive devices.

11. A bowling sensor for sensing bowling pins standing on the pin deck of a bowling lane, comprising the combination a linear array of semiconductor photodiodes packaged in a housing, an elongate, thin, translucent aperture in said housing extending parallel to said array for admitting light from outside the package onto the linear array of photodiodes, an optical system disposed in front of said photodiode array and having a principal axis directed toward the pin deck, said optical system providing a reduction ratio considerably greater than unity, thereby to provide a horizontal field of view that includes at least a full set of bowling pins on their respective spots on the pin deck and to provide a vertical field of view that includes approximately the top five inches of the standing pins on the pin deck, respective signal storage means associated with each of said photodiodes, said storage means and photodiodes operating in response to light incident on the photodiode to cause a signal to be stored on each storage means that is a function of the intensity of light incident on its respective photodiode, means for sampling said signal storage means to provide pin signals represenative of sensed standing bowling pins.

* * * * *